US005722545A

United States Patent [19]

Rinne

[11] Patent Number: 5,722,545

[45] Date of Patent: Mar. 3, 1998

[54] CONTAINER WITH TWIST-ON-OFF CLOSURE CAP

[75] Inventor: Rolf Rinne, Frankfurt am Main, Germany

[73] Assignee: Dental-Kosmetik GmbH, Dresden, Germany

[21] Appl. No.: 624,449

[22] PCT Filed: Oct. 31, 1994

[86] PCT No.: PCT/DE94/01280

§ 371 Date: Apr. 5, 1996

§ 102(e) Date: Apr. 5, 1996

[87] PCT Pub. No.: WO95/15892

PCT Pub. Date: Jun. 15, 1995

[30] Foreign Application Priority Data

Dec. 10, 1993 [DE] Germany ..... 43 42 251.9

[51] Int. Cl.[6] ..... B65D 1/02

[52] U.S. Cl. ..... 215/44; 215/45; 215/330; 215/344; 215/352

[58] Field of Search ..... 215/45, 44, 330, 215/331, 341, 344, 352, DIG. 1

[56] References Cited

U.S. PATENT DOCUMENTS

| | | | |
|---|---|---|---|
| 3,717,287 | 2/1973 | Marand | 222/153 |
| 3,986,626 | 10/1976 | Montgomery | 215/216 |
| 4,519,518 | 5/1985 | Wiles et al. | 215/331 |
| 4,770,308 | 9/1988 | Lynn | 215/330 |
| 5,009,323 | 4/1991 | Montgomery et al. | 215/252 |
| 5,184,741 | 2/1993 | Chevassus et al. | 215/331 |
| 5,533,633 | 7/1996 | King | 215/252 |

FOREIGN PATENT DOCUMENTS

| | | | |
|---|---|---|---|
| 2203729 A | 10/1988 | United Kingdom | 215/330 |
| 0085003 | 8/1983 | WIPO | 215/330 |

*Primary Examiner*—Stephen Cronin
*Attorney, Agent, or Firm*—Darby & Darby

[57] ABSTRACT

A twist-off closure is disclosed for all kinds of containers having a head and a closure cap. The container head has at its top end a sealing lip shaped as a circumferential bead. A steep, multiple-start thread is located below the sealing lip. A fin is arranged between each winding of the steep thread and the container shoulder. The closure cap has a corresponding inner thread that co-operates in the closed state with the fins of the container head causing the closure cap to be clamped, so as to prevent the container from being unintentionally opened by itself. In the closed state, the first part of the windings of the thread of the closure cap engage the fins of the container head, and this is clearly perceived as a pressure point when twisting the cap by hand. All that is required to open and close the closure cap is to twist it through a half turn. The cylindrical inner part of the closure cap forms a movable seal together with the circumferential lip of the container head, preventing the contents of the container from flowing out, so that the tightness of the container is ensured even when the closure cap is only negligently screwed (for example only up to the pressure point). In addition, once the pressure point is reached, the closure cap is reliably prevented from opening by itself.

5 Claims, 3 Drawing Sheets

CONTAINER WITH TWIST-ON-OFF CLOSURE CAP

BACKGROUND OF THE INVENTION

1. Field of the Invention

The Invention relates to a twist-off closure, also called fractal closure for any container having a closures cap and a container head. The closure is provided for a container of arbitrary dimensions, and of arbitrary design to be closed with a closure cap, wherein the container includes an integral container head with an opening for dispensing liquid, paste-like, or potable substances.

For closing of containers predominantly used in households, there exist stoppers, crown caps, and closure caps, the latter in the form of classical screw caps, preferably with an inner thread and a closed-off bottom or cover, or in a more recent configuration, with an integral hinged lid, also called one-hand hinged lid cover. Opening a classical screw cap requires more than half a turn, generally an entire turn or more, which is quite disadvantageous for the user.

With containers used with their opening pointing downwardly, e.g. tooth paste tubes, the contents can be released prematurely and unintentionally. Lid covers can open by themselves, especially when some of the contents of the container is spread around the exit opening which occurs quite frequently with paste-like products. The hygienic imperviousness of the lid cover is then not always assured. In order to overcome the aforementioned disadvantages, several technical solutions are known.

2. Description of the Related Art

Closures are described in DE 37 42 692 A1, DE 40 29 467 A1, DE 29 13 883 A1, and DE 32 47 353 A1 which will open completely after only ¼ turn and which do assure a noticeable engagement and disengagement of the closure when the closure is turned. In order to accomplish this, circumferential beads, latching grooves and cams, as well as lips are employed. The threads are multiple-start threads with a pitch angle between to 30° and 45°.

In GB 21 81 721 A, a closure is described where a fin is provided on the container head, but where this fin is utilized as a stop for defining the relative orientation between the closure cap and the container.

It is a disadvantage of the aforementioned technical embodiments that tightness of the closure against release of the container contents is not automatically guaranteed in case that the container is only negligently closed by merely twisting the closure cap up to the pressure point. The cap always has to be tightened until the final stop, i.e. beyond the pressure point.

From GB 2 203 729, there is known a closure type with thread sections arranged around the neck of the container, the thread sections corresponding to similar thread sections of the closure cap. In addition, each thread section comprises a fin. Thread sections and fins are constructed in a way that the during closure process portions of the thread sections can catch behind the fins.

Subject matter of the U.S. Pat. No. 5,009,323 is a closure with a standardized threaded cap, the cap comprising around its circumference a strip made from frangible material, whereby the strip is intended as protection against misuse and unauthorized opening.

In addition, the design and functionality of this freshness seal is described.

A sealing lip is provided on the container head of the closure which is received by the cylindrical portion of the cap when the closure cap is turned to open.

It is therefore an object of the invention to provide a generic twist-off closure which

- can be opened and closed with a brief twisting motion (less than 180° twist angle),
- is secured in the closed state against unintentional self-opening (clamped), and
- is tight against leaking of the contents even if only negligently closed (not tightened until the final stop).

SUMMARY OF THE INVENTION

This requirement is realized by way of the following characteristic features:

The twist-off closure according to the invention is characterized in that the container head comprises at its upper portion a sealing lip formed as a circumferential bead, a steep, multiple-start thread, and a number of fins equal to the number of threads. Here, several thread sections are provided which are distributed over the circumference at the lower portion of the container head, which are displaced in relation to each other, and which have a pitch of 30°.

The vertical fins oriented parallel to the longitudinal axis and having chamfered shoulders and cross section dimensions which scale with the dimensions of the thread, are arranged approximately centerline and proximate to the thread sections.

The threads of the closure cap are formed in a similar fashion as those of the container head; above the steep thread consisting of thread sections, there is provided a cylindrical portion for engaging the sealing lips. The sealing lip and the steep thread of the container head formed with vertical fins, guarantee, in conjunction with the corresponding steep thread of the closure cap, that the container contents does not leak out, if the closure cap is twisted half a turn against the noticeable pressure point.

When the closure cap is in this position, the first portion of the threads of the closure cap begin to press against the fins of the container head. When the closure cap is turned further, beyond the clearly noticeable pressure point, it clamps completely. Upon opening of the closure cap, the aforementioned effects take place in reverse order. The closure cap remains clamped up to a twist angle of 30°, i.e. the cap is prevented from opening by itself. The circumferential seal formed as a sealing lip in the container head, functions as a seal against unintentional spillage of the container contents up to a twist angle of 80°. Only when the closure cap is turned beyond 80° is the seal disengaging and the cap can be removed with an additional half turn.

In this way, removal of the contents can be easily accomplished and the user can reclose the container with a twisting motion with which (s)he is quite familiar with. In addition, there exists, on one hand, a large safety margin against premature and undesirable spillage of the contents as a result of the long clamping phase with a 30° twist angle; on the other hand, the contents can be quickly extracted since the closure cap can be removed after only half a turn. Hereby, the closure cap can be removed from and put onto the container and closed, without changing the position of the fingers.

The container is already secured against spillage at the first pressure point which occurs when the sealing lip formed as circumferential seal in the container head, engages with the sealing lip in the cylindrical portion of the closure cap (approx. 80° twist angle before complete closure). After passing the second pressure point which occurs when the first portion of the steep threads of the closure cap engages with the fins of the container head (approx. 30° twist angle before complete closure), the container is completely secured against unintentional opening, e.g. during vibrations.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the following, the scope of the invention is discussed in more detail and exemplified by the embodiments. In the appended drawings is shown in FIG. 1 a simplified sectional view of the container head and cylindrical closure cap, FIG. 2 an enlarged detail of the steep thread, sealing lip on the container head, and cylindrical closure cap which are features of the invention, FIG. 3 a simplified sectional view of the container head and tapered closure cap, FIG. 4 an enlarged detail of the steep thread, sealing lip on the container head, and tapered closure cap which are features of the invention, FIG. 5 a developmental plan view of the container head.

DETAILED DESCRIPTION OF THE PREFERRED EMBODIMENTS

Figure 2:
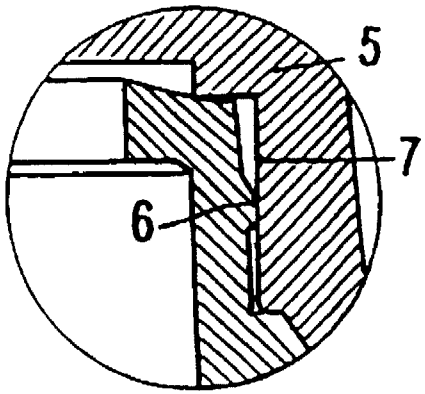
Figure 1:
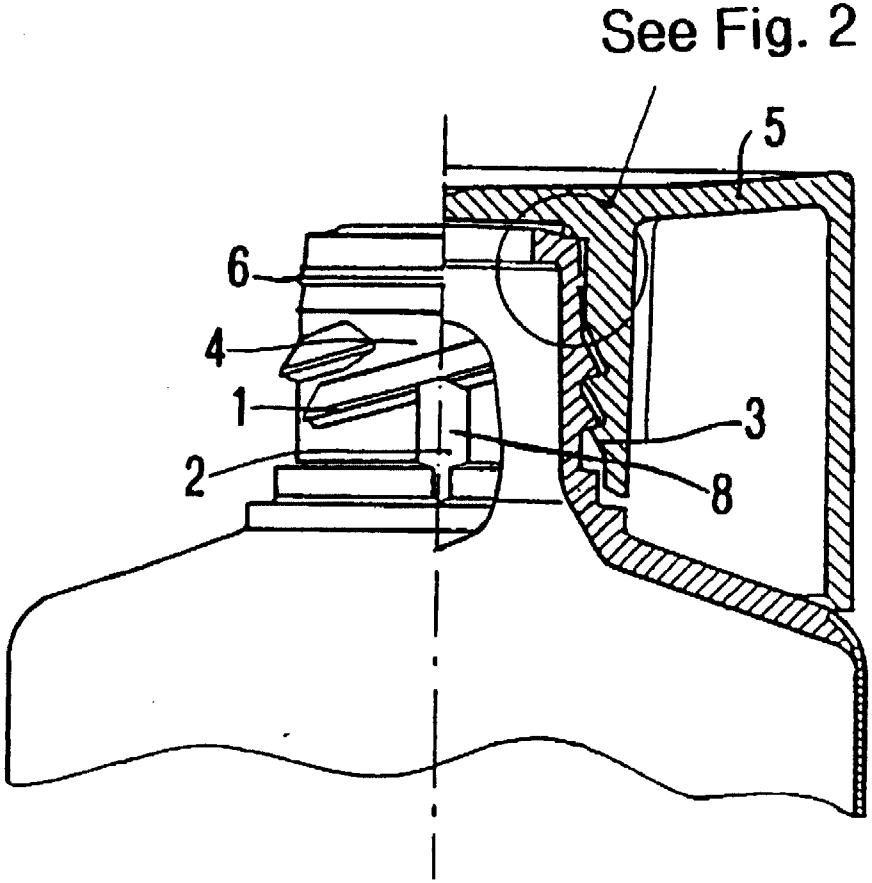

In the embodiment illustrated in FIG. 1 and 2, the container head 4 and the closure cap 5 are constructed from plastic, e.g. polyethylene. The steep thread 1 of the container head 4 comprises three threads with a pitch of 15°. The container cap has thread recesses 9 engaging with the threads 1 of the container head upon twist-on. When the closure cap 5 is being closed, the first pressure point is reached when the sealing lip 6 of the container head 4 begins to engage the cylindrical part 7 of the 6 closure cap 5. When the closure cap 5 has reached this position, the sealing lip formed as a circumferential seal, is sealing flush with the cylindrical part 7 of the closure cap 5, such that the container contents can no longer leak out.

When turning further, the crest of the first portion of the steep thread 3 of the closure cap 5 slides onto the fins 2 of the container head 4 which is perceived as a second pressure point. The pressing and clamping action continues until the closure cap has been screwed on completely (to the final stop).

The fins 2 are connected to the threads of the container head 4 in such a way that a small chamfer 8 is provided between the fins 2 and the crest of the thread facilitating the sliding motion of the latter onto the fins 2, such that no excessive torque is required when the closure cap 5 is screwed on.

Upon opening the closure cap, the effects described above occur in reverse order. The closure cap 5 is clamped to a twist angle of up to 30°, i.e. it is prevented from opening unintentionally by itself. Up to a twist angle of 80°, the circumferential seal 6 formed as a sealing lip in the container head 4, acts as a seal against unintentional leakage of the container contents. The seal disengages only after the closure cap 5 is turned more than 80°, and the cap can then be removed from the container head 4 with an additional half turn.

In this way, removal of the contents can be easily accomplished and the user can reclose the container with a twisting motion with which (s)he is quite familiar with. In addition, there exists, on one hand, a large safety margin against premature and undesirable spillage of the contents as a result of the long clamping phase with a 30° twist angle; on the other hand, the contents can be quickly extracted since the closure cap can be removed after only half a turn. Hereby, the closure cap can be removed from and put onto the container and closed, without changing the position of the fingers.

Altogether, the consumer can enjoy spending much less energy and time when opening and closing the container in comparison with standard twist closures, which makes handling much more user friendly.

Figure 4:
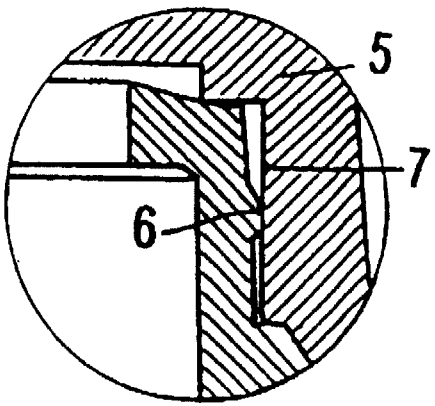
Figure 3:
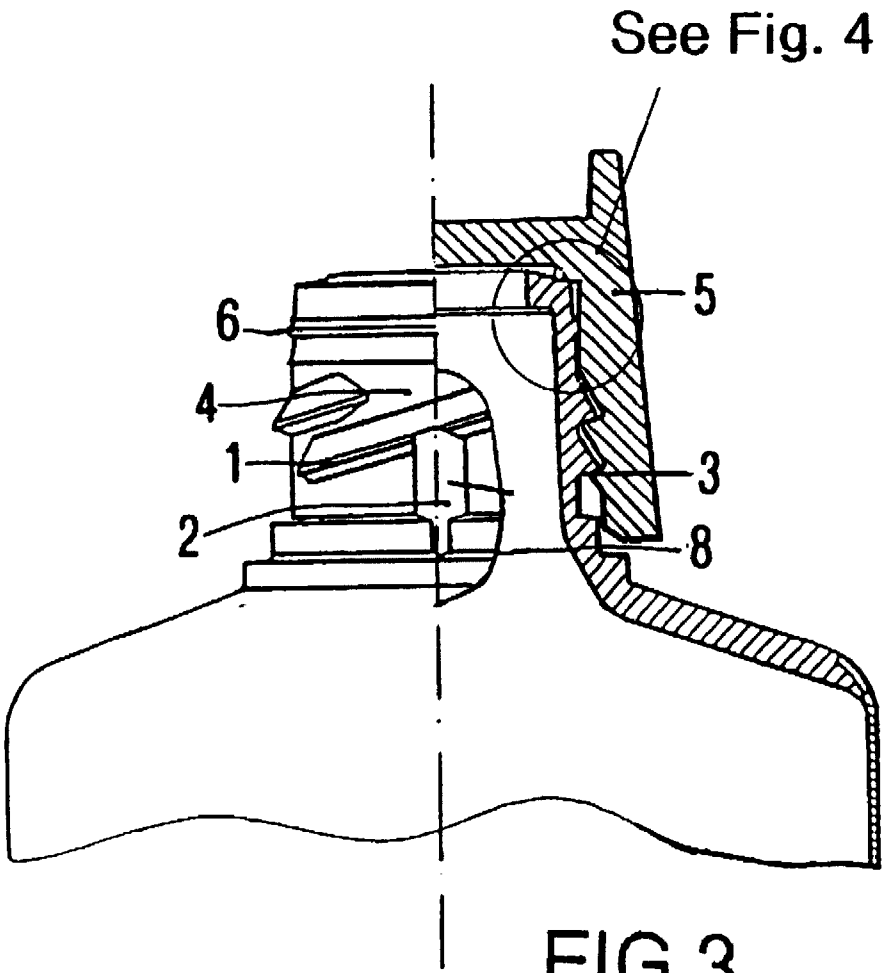
Figure 5:
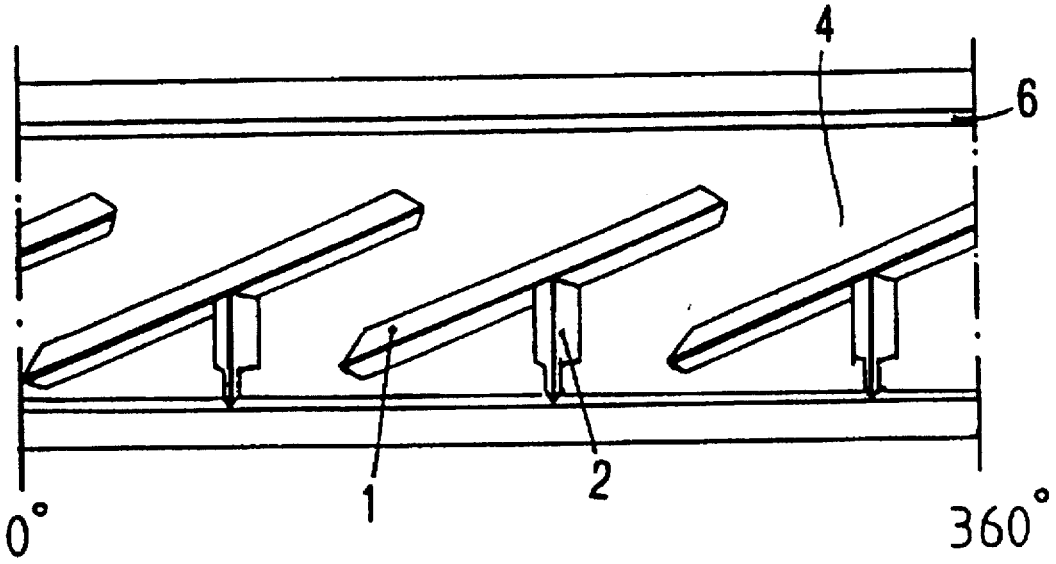

FIG. 3 and 4 show a tapered closure cap according to the invention, the implementation and functionality of which is identical with the preceding description.

Therefore, FIG. 3 and 4 only represent examples for the design of possible closure caps, and they are not claimed as separate inventions.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A container with a twist-on-twist-off closure cap comprising:

a container head having an upper portion and a lower portion, the container head including a plurality of thread segments arranged on the lower portion of the container head;

a plurality of vertical fins disposed on the container head below the plurality of thread segments and extending downwardly substantially in the center of the plurality of thread segments;

a sealing lip circumferentially arranged around the upper portion of the container head;

the closure cap comprising a plurality of thread segment recesses for engaging the plurality of thread segments, and a cylindrical section for accommodating the sealing lip;

the sealing lip is arranged such as to form a seal with the closure cap before the closure cap is twisted onto the container head;

the plurality of vertical fins sealingly engage with the plurality of thread segments upon twisting of the closure cap onto the container head.

2. The container with a twist-on-twist-off closure cap according to claim 1, wherein the plurality of thread segments and the plurality of thread segment recesses are three thread sections and three engaging thread segment recesses displaced parallel in relation to each other.

3. The container with a twist-on-twist-off closure cap according to claim 1, wherein the plurality of thread segments have a pitch of about 15°, so as to allowing opening and closing the container with a half turn.

4. The container with a twist-on-twist-off closure cap according to claim 1, wherein plurality of thread segments having a pitch of about 30°.

5. The container with a twist-on-twist-off closure cap according to claim 1, wherein the fins on the container head comprise chamfers for facilitating the sealing engagement with the plurality of thread segments upon twisting of the closure cap onto the container head.

* * * * *